US011512497B2

(12) United States Patent
Nylander et al.

(10) Patent No.: US 11,512,497 B2
(45) Date of Patent: Nov. 29, 2022

(54) REMOTELY CONTROLLED CABINET ASSEMBLY

(71) Applicants: William Nylander, Winters, CA (US); Melanie M. Cottone-Nylander, Winters, CA (US)

(72) Inventors: William Nylander, Winters, CA (US); Melanie M. Cottone-Nylander, Winters, CA (US)

( * ) Notice: Subject to any disclaimer, the term of this patent is extended or adjusted under 35 U.S.C. 154(b) by 654 days.

(21) Appl. No.: 16/545,978

(22) Filed: Aug. 20, 2019

(65) Prior Publication Data

US 2021/0054654 A1 Feb. 25, 2021

(51) Int. Cl.

| | |
|---|---|
| ***E05B 47/00*** | (2006.01) |
| ***A47B 67/02*** | (2006.01) |
| ***E05G 1/04*** | (2006.01) |
| ***E05B 65/00*** | (2006.01) |
| ***E05B 47/06*** | (2006.01) |

(Continued)

(52) U.S. Cl.

CPC ..... *E05B 47/0001* (2013.01); *A47B 67/02* (2013.01); *E05B 47/026* (2013.01); *E05B 47/0603* (2013.01); *E05B 49/00* (2013.01); *E05B 65/0075* (2013.01); *E05G 1/04* (2013.01); *E05G 1/06* (2013.01); *G07C 9/00571* (2013.01); *A47B 2067/025* (2013.01); *E05B 2047/0016* (2013.01); *E05B 2047/0054* (2013.01); *E05B 2047/0073* (2013.01); *E05B 2047/0095* (2013.01)

(58) Field of Classification Search

CPC ..... E05B 47/0001; E05B 47/0004; E05B 47/026; E05B 47/0603; E05B 2047/0016; E05B 2047/0048; E05B 2047/0054; E05B 2047/0067; E05B 2047/0073; E05B 2047/0094; E05B 2047/0095; E05B 49/00; E05B 65/0003; E05B 65/0075; E05B 65/06; E05B 65/44; E05G 1/026; E05G 1/04; E05G 1/06; A47B 67/02; A47B 2067/025; G07C 9/00571

See application file for complete search history.

(56) References Cited

U.S. PATENT DOCUMENTS 3,008,785 A * 11/1961 Gehrs ..... A47B 67/005 312/351

4,663,621 A 5/1987 Field (Continued)

FOREIGN PATENT DOCUMENTS

WO WO2014022795 2/2014

*Primary Examiner* — Christopher J Boswell

(57) ABSTRACT

A remotely controlled cabinet assembly includes a cabinet unit that includes a central cabinet and a door that is hingedly coupled to the central cabinet. A plurality of locking units is each coupled to the central cabinet. Each of the locking units releasably engages the door for locking the door on the central cabinet. A control unit is coupled to the cabinet unit and the control unit is electrically coupled to each of the locking units. The control unit actuates each of the locking units to disengage and thusly unlock the door on the central cabinet. A keypad is coupled to the door and each of the locks disengages the door when an alpha-numeric code is entered into the keypad. An electronic device is carried by a user and the electronic device transmits an unlock command to the control unit for remotely unlocking the door on the central cabinet.

7 Claims, 5 Drawing Sheets

(51) Int. Cl.

| | |
|---|---|
| ***G07C 9/00*** | (2020.01) |
| ***E05B 47/02*** | (2006.01) |
| ***E05B 49/00*** | (2006.01) |
| ***E05G 1/06*** | (2006.01) |

(56) References Cited

U.S. PATENT DOCUMENTS

| | | | | |
|---|---|---|---|---|
| 6,883,440 | B1 * | 4/2005 | Correia | E05G 1/04 70/1.5 |
| 8,479,543 | B2 * | 7/2013 | Yang | E05G 1/04 70/284 |
| 9,273,492 | B2 | 3/2016 | Gokcebay | |
| 9,322,207 | B2 * | 4/2016 | Savage | E05G 1/04 |
| D789,768 | S | 6/2017 | Hsu | |
| 9,739,083 | B2 | 8/2017 | Hermann | |
| 9,889,979 | B2 * | 2/2018 | Nelson | E05G 1/005 |
| 10,316,573 | B2 * | 6/2019 | Green | E05G 1/04 |
| 10,513,379 | B2 * | 12/2019 | McBride | E05B 65/52 |
| 10,808,449 | B1 * | 10/2020 | Goetz | E05G 1/06 |
| 2006/0152339 | A1 * | 7/2006 | Mercier | G07F 17/12 340/5.73 |
| 2019/0085616 | A1 * | 3/2019 | Soufflet | E05G 1/04 |
| 2019/0110952 | A1 * | 4/2019 | Wallace | E05G 1/04 |
| 2020/0402340 | A1 * | 12/2020 | Lössov | G07F 17/12 |
| 2021/0207423 | A1 * | 7/2021 | Hervey | E05G 1/04 |

* cited by examiner

REMOTELY CONTROLLED CABINET ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to locking cabinet devices and more particularly pertains to a new locking cabinet device for storing controlled substances.

BRIEF SUMMARY OF THE INVENTION

An embodiment of the disclosure meets the needs presented above by generally comprising a cabinet unit that includes a central cabinet and a door that is hingedly coupled to the central cabinet. A plurality of locking units is each coupled to the central cabinet. Each of the locking units releasably engages the door for locking the door on the central cabinet. A control unit is coupled to the cabinet unit and the control unit is electrically coupled to each of the locking units. The control unit actuates each of the locking units to disengage and thusly unlock the door on the central cabinet. A keypad is coupled to the door and each of the locks disengages the door when an alpha-numeric code is entered into the keypad. An electronic device is carried by a user and the electronic device transmits an unlock command to the control unit for remotely unlocking the door on the central cabinet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
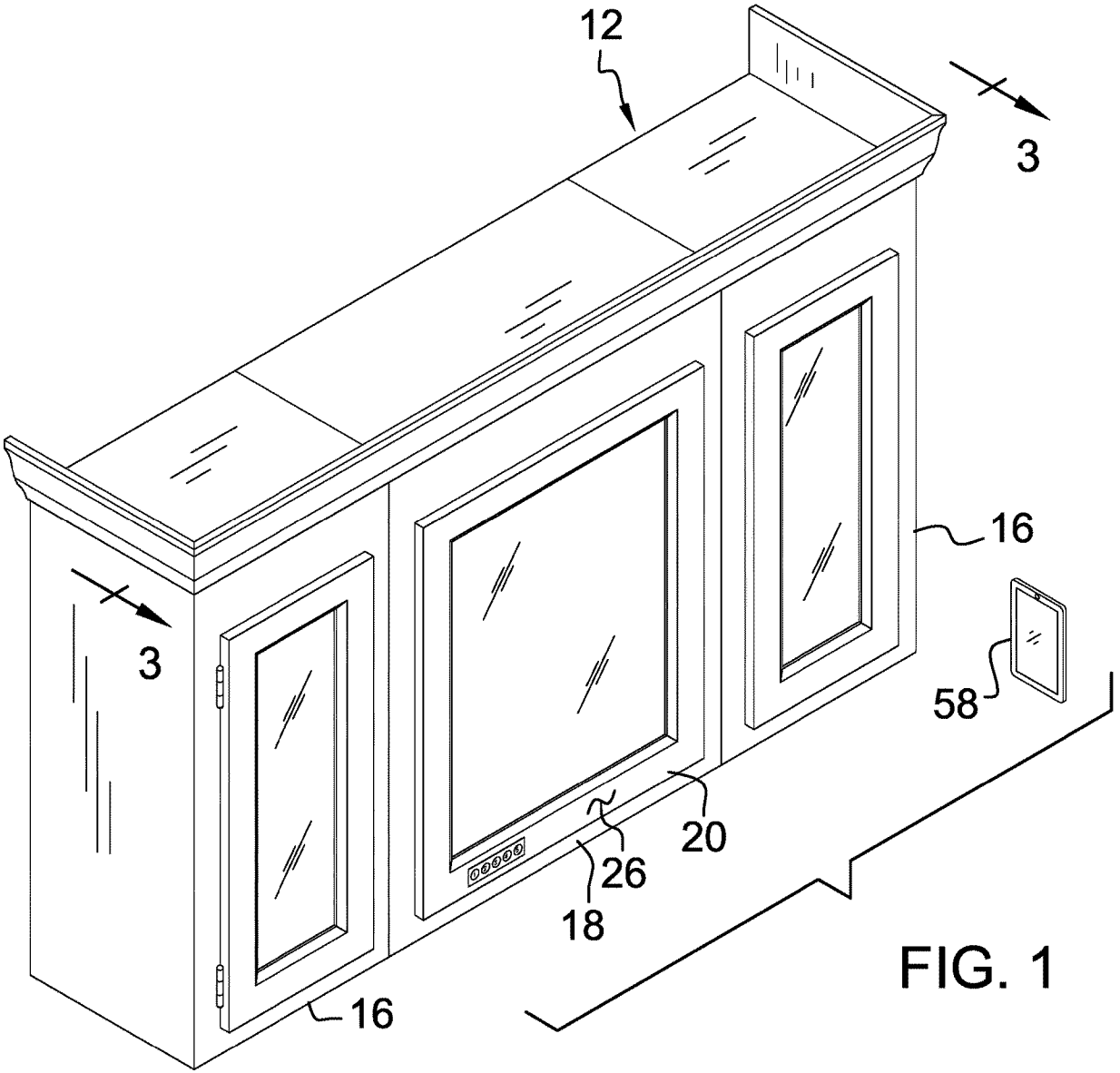
FIG. 1 is a front perspective view of a remotely controlled cabinet assembly according to an embodiment of the disclosure.
Figure 2:
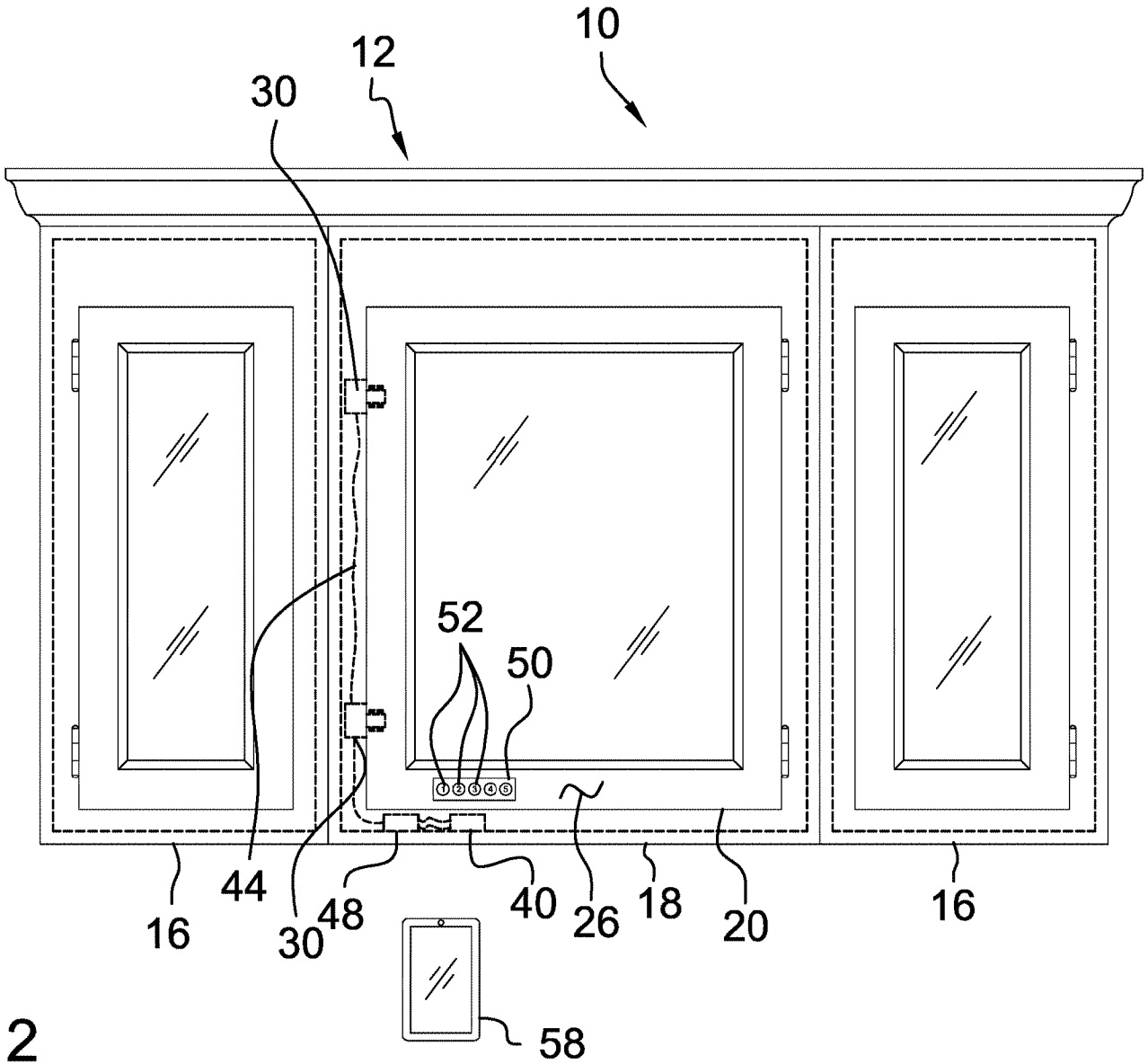
FIG. 2 is a front phantom view of an embodiment of the disclosure.
Figure 3:
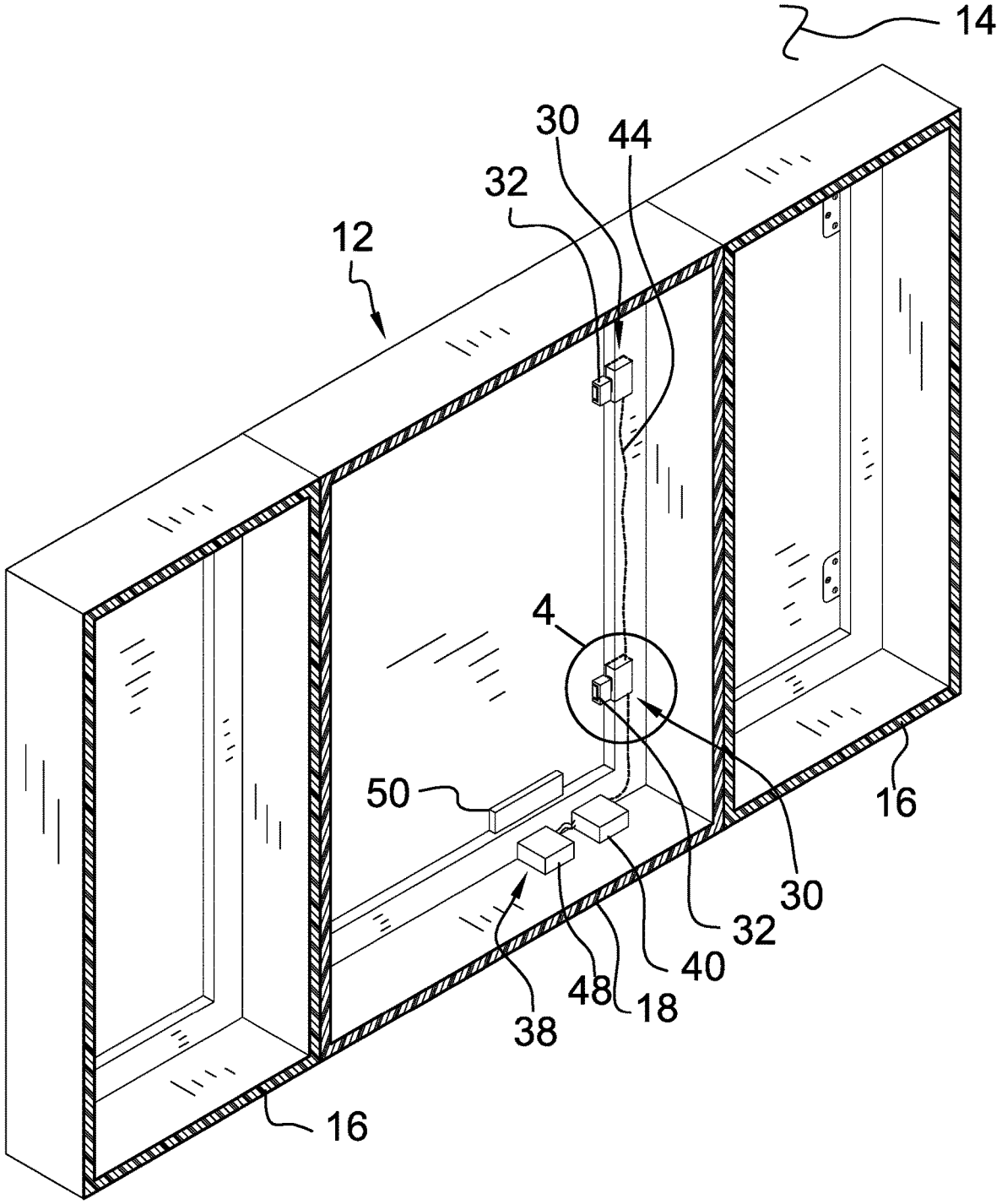
FIG. 3 is a cross sectional view taken along line 3-3 of FIG. 1 of an embodiment of the disclosure.
Figure 4:
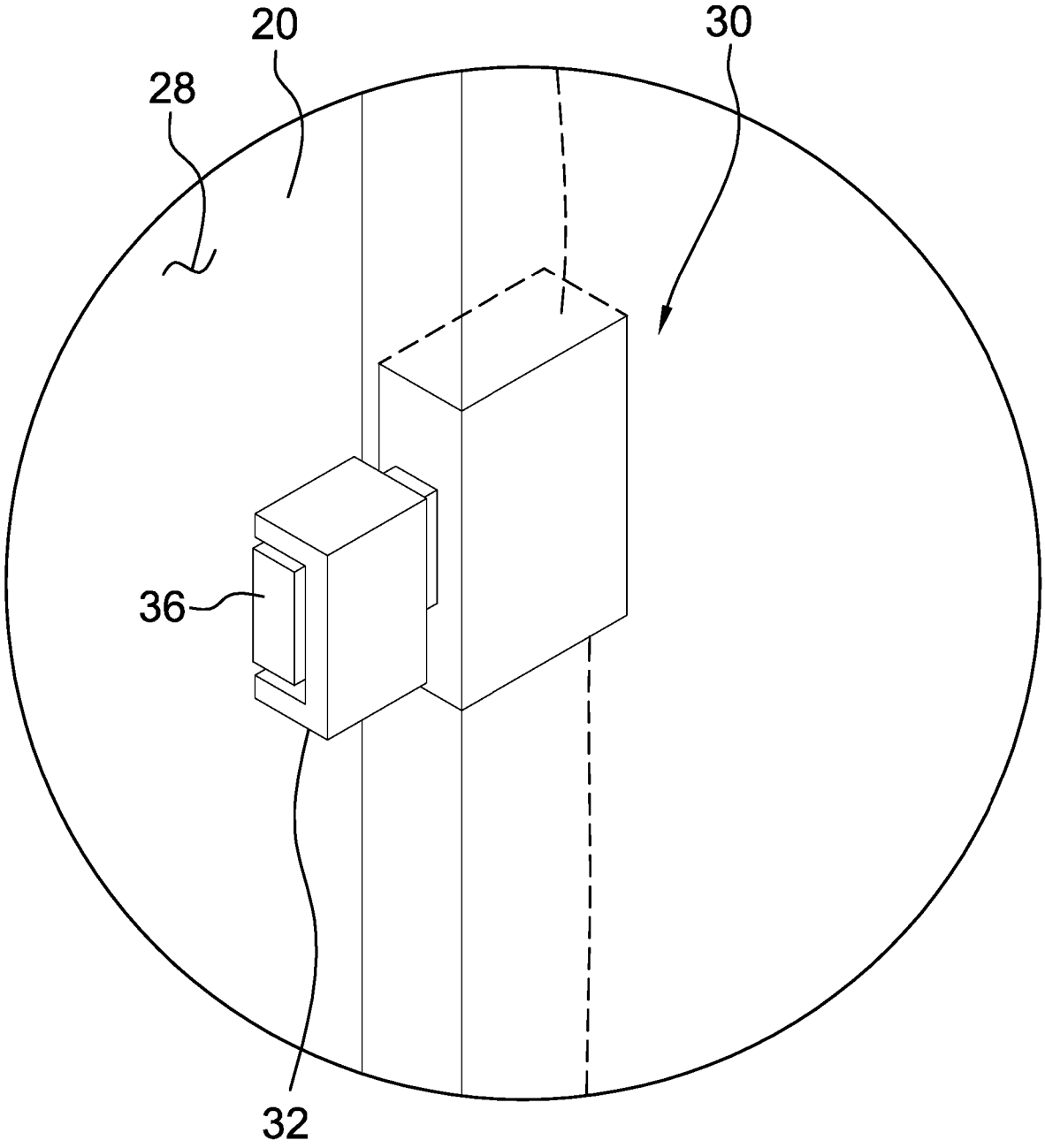
FIG. 4 is a detail view taken from circle 4 of FIG. 3 of an embodiment of the disclosure.
Figure 5:
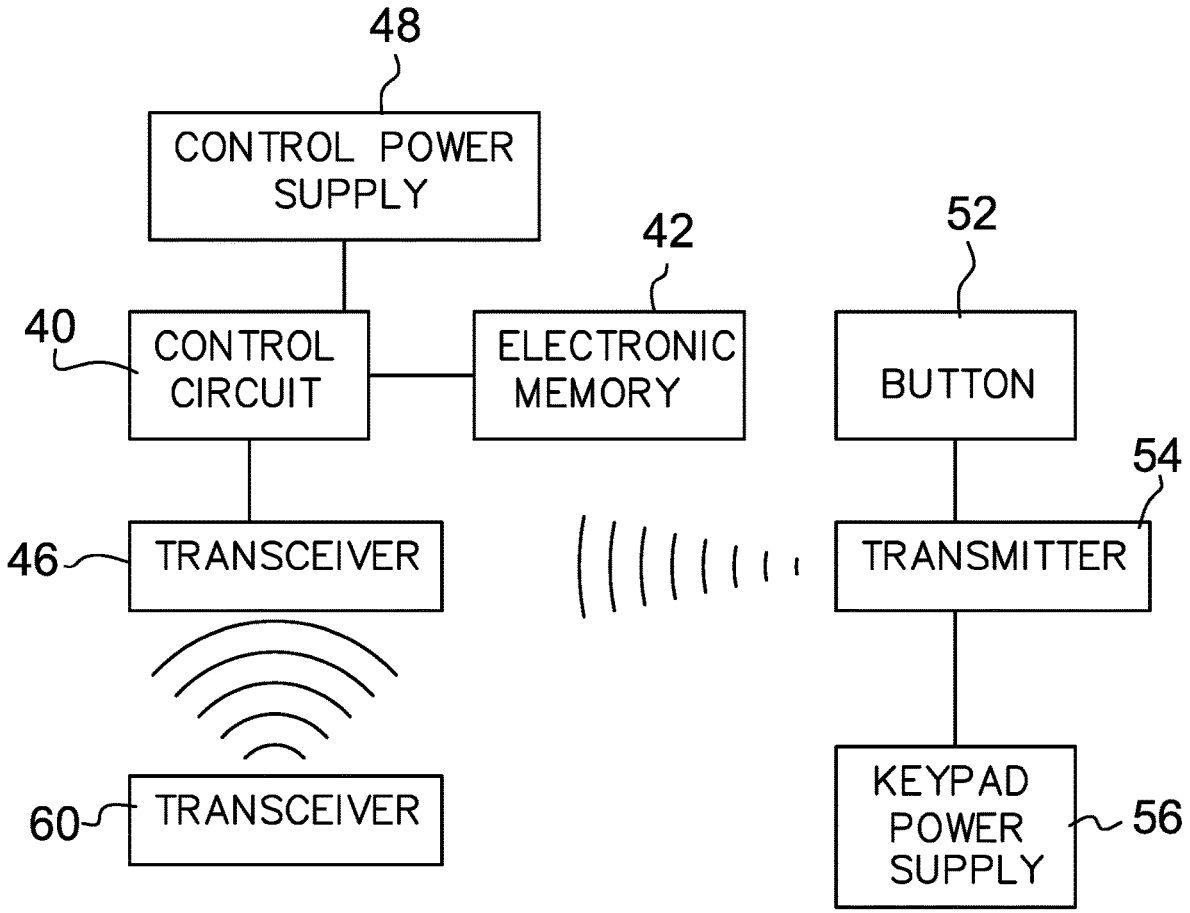
FIG. 5 is a schematic view of an embodiment of the disclosure.

With reference now to the drawings, and in particular to FIGS. 1 through 5 thereof, a new locking cabinet device embodying the principles and concepts of an embodiment of the disclosure and generally designated by the reference numeral 10 will be described.

As best illustrated in FIGS. 1 through 5, the remotely controlled cabinet assembly 10 generally comprises a cabinet unit 12 that is positionable on a vertical support surface 14. The vertical support surface 14 may be a wall in a bathroom or the like and the cabinet unit 12 may have structural features common to conventional cabinetry. The cabinet unit 12 has a pair of end cabinets 16 that is each positioned on either side of a central cabinet 18. The central cabinet 18 may store controlled substances, such as opioid pain killers or other prescription medication. The central cabinet 18 includes a door 20 that is hingedly coupled thereto, a door frame 22 and a bottom wall 24, and the door 20 on the central cabinet 18 has a front surface 26 and a back surface 28.

A plurality of locking units 30 is provided and each of the locking units 30 is coupled to the central cabinet 18. Each of the locking units 30 releasably engages the door 20 on the central cabinet 18 for locking the door 20 on the central cabinet 18. In this way each of the locking units 30 can restrict access to the controlled substances in the central cabinet 18. Each of the locking units 30 comprises a pair of bolt receivers 32 that is each coupled to the back surface 28 of the door 20 on the central cabinet 18.

Each of the locking units 30 includes a pair of locks 34 that is each coupled to the door frame 22 of the central cabinet 18. Each of the locks 34 is aligned with a respective one of the bolt receivers 32 on the door 20 on the central cabinet 18. Each of the locks 34 includes a bolt 36 that is positionable in an extended position or a retracted position. The bolt 36 on each of the locks 34 is biased into the extended position. Moreover, the bolt 36 on each of the locks 34 engages the respective bolt receiver 32 when the bolt 36 is in the extended position for locking the door 20 on the central cabinet 18. The bolt 36 on each of the locks 34 disengages the respective bolt receiver 32 when the bolt 36 is positioned in the retracted position for unlocking the door 20 on the central cabinet 18. Each of the locks 34 may comprise electro-mechanical locks or the like.

A control unit 38 is provided and the control unit 38 is coupled to the cabinet unit 12. The control unit 38 is electrically coupled to each of the locking units 30. The control unit 38 actuates each of the locking units 30 to disengage and thusly unlock the door 20 on the central cabinet 18. In this way the control unit 38 facilitates access to the controlled substances in the central cabinet 18. The control unit 38 comprises a control circuit 40 that is coupled to the central cabinet 18. The control circuit 40 is positioned on the bottom wall 24 of the central cabinet 18 and is positioned within the central cabinet 18. The control circuit 40 is electrically coupled to each of the locks 34 and the control circuit 40 includes an electronic memory 42 that stores a pre-determined alpha numeric code.

A plurality of conductors 44 is provided and each of the conductors 44 is embedded in the door frame 22 on the central cabinet 18. Each of the conductors 44 is electrically coupled between the control circuit 40 and a respective one of the locks 34. A transceiver 46 is coupled to the bottom wall 24 of the central cabinet 18 and is positioned within the central cabinet 18, and the transceiver 46 is electrically coupled to the control circuit 40. The transceiver 46 may be a radio frequency transceiver 46 or the like. A control power supply 48 is coupled to the bottom wall 24 of the central cabinet 18 and is positioned within the central cabinet 18. The control power supply 48 is electrically coupled to the control circuit 40 and the control power supply 48 comprises at least one battery.

A keypad 50 is coupled to the door 20 on the central cabinet 18, the keypad 50 can be manipulated by a user and the keypad 50 is positioned on the front surface 26 of the door 20 on the central cabinet 18. The keypad 50 has plurality of buttons 52 thereon for entering a pre-determined alpha-numeric code into the keypad 50. Additionally, the keypad 50 is in electrical communication with the control unit 38 and the control unit 38 actuates each of the locks 34 to disengage the door 20 on the central cabinet 18 when the alpha-numeric code is entered into the keypad 50. In this way the controlled substances in the central cabinet 18 can be accessed.

A transmitter 54 is positioned within the keypad 50 and the transmitter 54 is electrically coupled to the keypad 50. The transmitter 54 is in wireless communication with the transceiver 46 in the control unit 38 for communicating the alpha-numeric code entered in the keypad 50 to the control circuit 40. The transmitter 54 may be a radio frequency transmitter 54 or the like and the transmitter 54 facilitates the keypad 50 to communicate with the control unit 38 regardless of whether the door 20 is opened or closed. A keypad power supply 56 is positioned within the keypad 50, the keypad power supply 56 is electrically coupled to the keypad 50 and the keypad power supply 56 comprises at least one battery.

An electronic device 58 is included that is carried by a user. The electronic device 58 includes a transceiver 60 and the transceiver 60 in the electronic device 58 is in wireless electrical communication with the transceiver 46 in the control unit 38. Moreover, the electronic device 58 transmits an unlock command to the control unit 38 for remotely unlocking the door 20 on the central cabinet 18. In this way the electronic device 58 facilitates an authorized user to unlock the door 20 on the central cabinet 18 from any location. The electronic device 58 may store an application or other type of program to facilitate the alpha-numeric code to be entered into the electronic device 58 and thusly be transmitted to the control unit 38.

In use, the controlled substances, or any other substance, is stored in the central cabinet 18 for secure storage. The pre-determined alpha-numeric code must be entered into the keypad 50 in order to open the door 20 on the central cabinet 18 and thusly access the controlled substances. Alternatively, the electronic device 58 can be manipulated to remotely unlock the door 20 on the central cabinet 18. In this way the controlled substances can be securely stored thereby reducing the likelihood that the controlled substances can be accessed by unauthorized users, such as children or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A remotely controlled cabinet assembly being configured to be remotely locked and unlocked for storing controlled substances, said assembly comprising:

a cabinet unit being positionable on a vertical supports surface, said cabinet unit having a pair of end cabinets each being positioned on either side of a central cabinet, said central cabinet being configured to store controlled substances, said central cabinet including a door being hingedly coupled thereto, a door frame and a bottom wall, said door on said central cabinet having a front surface and a back surface;

a plurality of locking units, each of said locking units being coupled to a said central cabinet, each of said locking units releasably engaging said door on said central cabinet for locking said door on said central cabinet wherein each of said locking units is configured to restrict access to the controlled substances in said central cabinet;

a control unit being coupled to said cabinet unit, said control unit being electrically coupled to each of said locking units, said control unit actuating each of said locking units to disengage and thusly unlock said door on said central cabinet Wherein said control unit is configured to facilitate access to the controlled substances in said central cabinet;

a keypad being coupled to said door on said central cabinet wherein said keypad is configured to be manipulated by a user, said keypad having plurality of buttons thereon for entering a pre-determined alphanumeric code, said keypad being in electrical communication with said control unit, said control unit actuating each of said locks to disengage said door on said central cabinet when said alpha-numeric code is entered into said keypad, and an electronic device being carried by a user, said electronic device transmitting an unlock command to said control unit, for remotely unlocking said door on said central cabinet.

2. The assembly according to claim 1, Wherein each of said locking units comprises:

a pair of bolt receivers, each of said bolt receivers being coupled to said back surface of said door on said central cabinet;

a pair of locks, each of said locks being coupled to said door frame of said central cabinet, each of said locks being aligned with a respective one of said bolt receivers on said door on said central cabinet, each of said locks including a bolt being positionable in an extended position or a retracted position, said bolt on each of said locks being biased into said extended position; and said bolt on each of said locks engages said respective bolt receiver when said bolt is in said extended position for locking said door on said central cabinet, said bolt on each of said locks disengaging said respective bolt receiver when said bolt is positioned in said retracted position for unlocking said door on said central cabinet.

3. The assembly according to claim 2, wherein said control unit comprises:

a control circuit being coupled to said central cabinet, said control circuit being positioned on said bottom wall of said central cabinet and being positioned within said central cabinet, said control circuit being electrically coupled to each of said locks, said control circuit including an electronic memory storing a pre-determined alpha numeric code; and a plurality of conductors, each of said conductors being embedded in said door frame on said central cabinet, each of said conductors being electrically coupled between said control circuit and a respective one of said locks.

4. The assembly according to claim 3, further comprising:

a transceiver being coupled to said bottom wall of said central cabinet and being positioned within said central cabinet; said transceiver being electrically coupled to said control circuit; and a control power supply being coupled to said bottom wall of said central cabinet and being positioned within said central cabinet, said control power supply being electrically coupled to said control circuit, said control power supply comprising at least one battery.

5. The assembly according to claim 4, further comprising:

a transmitter being positioned within said keypad, said transmitter being electrically coupled to said keypad, said transmitter being in wireless communication with said transceiver in said control unit for communicating said alpha-numeric code entered in said keypad to said control circuit; and a keypad power supply being positioned within said keypad, said keypad power supply being electrically coupled to said keypad, said keypad power supply comprising at least one battery.

6. The assembly according to claim 4, wherein said electronic device includes a transceiver, said transceiver in said electronic device being in wireless electrical communication with said transceiver in said control unit.

7. A remotely controlled cabinet assembly being configured to be remotely locked and unlocked for storing controlled substances, said assembly comprising:

a cabinet unit being positionable on a vertical supports surface, said cabinet unit having a pair of end cabinets each being positioned on either side of a central cabinet, said central cabinet being configured to store controlled substances, said central cabinet including a door being hingedly coupled thereto, a door frame and a bottom wall, said door on said central cabinet having a front surface and a back surface;

a plurality of locking units, each of said locking units being coupled to a said central cabinet, each of said locking units releasably engaging said door on said central cabinet for locking said door on said central cabinet wherein each of said locking units is configured to restrict access to the controlled substances in said central cabinet, each of said locking units comprising:

a pair of bolt receivers, each of said bolt receivers being coupled to said back surface of said door on said central cabinet; and a pair of locks, each of said locks being coupled to said door frame of said central cabinet, each of said locks being aligned with a respective one of said bolt receivers on said door on said central cabinet, each of said locks including a bolt being positionable in an extended position or a retracted position, said bolt on each of said locks being biased into said extended position, said bolt on each of said locks engaging said respective bolt receiver when said bolt is in said extended position for locking said door on said central cabinet, said bolt on each of said locks disengaging said respective bolt receiver when said bolt is positioned in said retracted position for unlocking said door on said central cabinet;

a control unit being coupled to said cabinet unit, said control unit being electrically coupled to each of said locking units, said control unit actuating each of said locking units to disengage and thusly unlock said door on said central cabinet wherein said control unit is configured to facilitate access to the controlled substances in said central cabinet, said control unit comprising:

a control circuit being coupled to said central cabinet, said control circuit being positioned on said bottom wall of said central cabinet and being positioned within said central cabinet, said control circuit being electrically coupled to each of said locks, said control circuit including an electronic memory storing a pre-determined alpha numeric code;

a plurality of conductors, each of said conductors being embedded in said door frame on said central cabinet, each of said conductors being electrically coupled between said control circuit and a respective one of said locks;

a transceiver being coupled to said bottom wall of said central cabinet and being positioned within said central cabinet, said transceiver being electrically coupled to said control circuit; and a control power supply being coupled to said bottom wall of said central cabinet and being positioned within said central cabinet, said control power supply being electrically coupled to said control circuit, said control power supply comprising at least one battery; and a keypad being coupled to said door on said central cabinet wherein said keypad is configured to be manipulated by a user, said keypad having plurality of buttons thereon for entering a pre-determined alpha-numeric code, said keypad being in electrical communication with said control unit, said control unit actuating each of said locks to disengage said door on said central cabinet when said alpha-numeric code is entered into said keypad, said keypad being positioned on said front surface of said door on said central cabinet;

a transmitter being positioned within said keypad, said transmitter being electrically coupled to said keypad, said transmitter being in wireless communication with said transceiver in said control unit for communicating said alpha-numeric code entered in said keypad to said control circuit;

a keypad power supply being positioned within said keypad, said keypad power supply being electrically coupled to said keypad, said keypad power supply comprising at least one battery; and an electronic device being carried by a user, said electronic device including a transceiver, said transceiver in said electronic device being in wireless electrical communication with said transceiver in said control unit, said electronic device transmitting an unlock command to said control unit for remotely unlocking said door on said central cabinet.

* * * * *